United States Patent [19]

Libit

[11] 4,429,815

[45] Feb. 7, 1984

[54] ROTATING DISPENSER CAP

[76] Inventor: Sidney M. Libit, 441 Lakeside Ter., Glencoe, Ill. 60022

[21] Appl. No.: 320,735

[22] Filed: Nov. 12, 1981

[51] Int. Cl.[3] ..... B67D 3/00

[52] U.S. Cl. ..... 222/452; 222/484

[58] Field of Search ..... 222/370, 362, 355, 427, 222/428, 429, 452, 485, 548, 484

[56] References Cited

U.S. PATENT DOCUMENTS

| | | | |
|---|---|---|---|
| 1,901,487 | 3/1933 | Alexander | 222/452 |
| 2,971,681 | 2/1961 | Galbierz | 222/548 |
| 3,129,853 | 4/1964 | Hoskins . | |
| 3,211,334 | 10/1965 | McShea | 222/452 X |
| 3,308,995 | 3/1967 | Lee et al. | 222/427 |
| 3,327,905 | 6/1967 | Gould . | |

*Primary Examiner*—Stanley H. Tollberg

*Attorney, Agent, or Firm*—Hill, Van Santen, Steadman & Simpson

[57] ABSTRACT

A two-piece rotary dispensing cap for a jar or container containing granular or powdered material comprises a cylindrical cap body having one end threaded for connection to the mouth of the jar or container and a relatively rotatable metering disk member overlying the cap body formed with one or more discharge openings through which material is dispensed exterior of the jar or container. The cap body is formed with an enclosed collection chamber having upper and lower open ends. The upper end faces the exterior of the container and the lower end is exposed in and directly communicates with the interior contents of the jar or container. The disk member is formed with a rotatable shaft received in the cap body and formed at its interior, lower end with a planar valve plate. The valve plate is disposed to directly underlie one of the discharge openings formed in the disk member and serves to block off flow communication between the lower open end of the collection chamber and the interior of the jar or container when material previously collected in the chamber is being dispensed through the chamber upper end and that one opening in the disk member.

21 Claims, 9 Drawing Figures

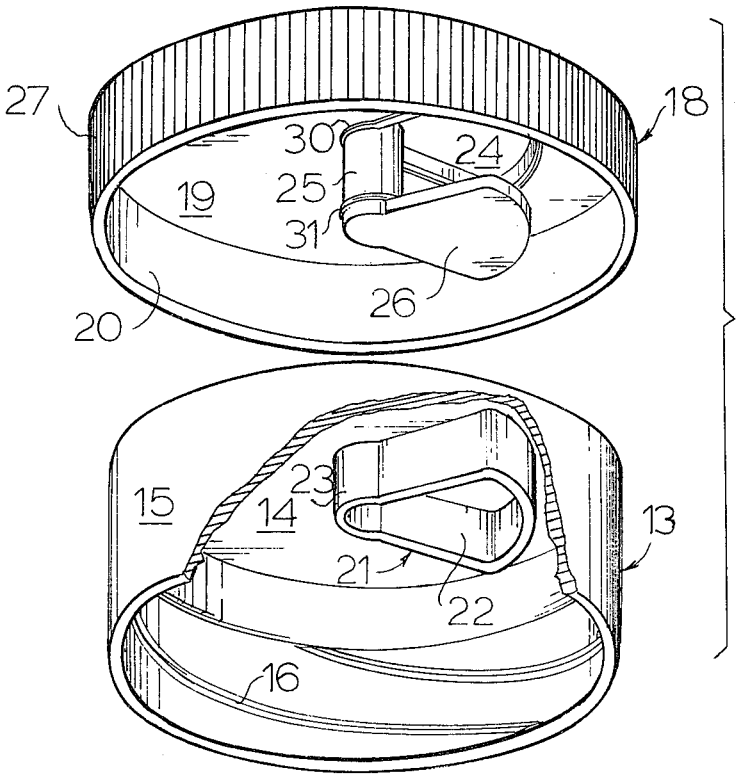
FIG. 5
FIG. 6
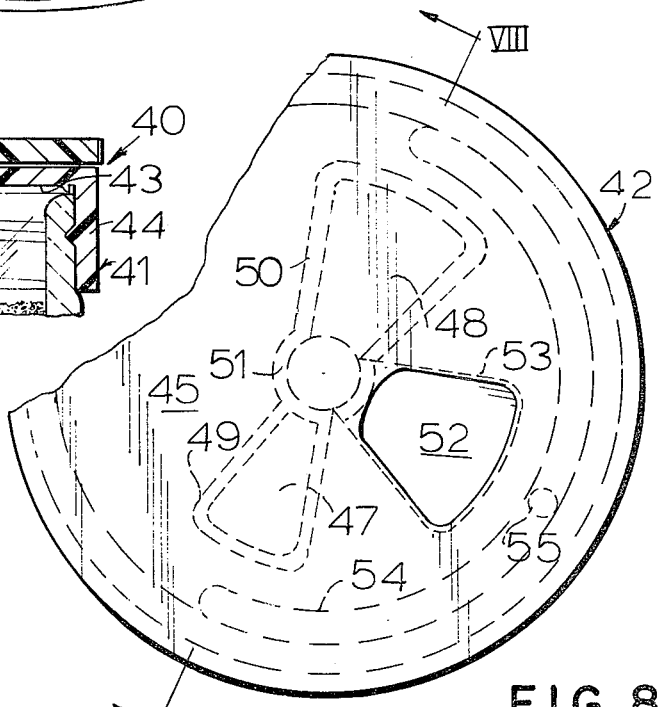
FIG. 7
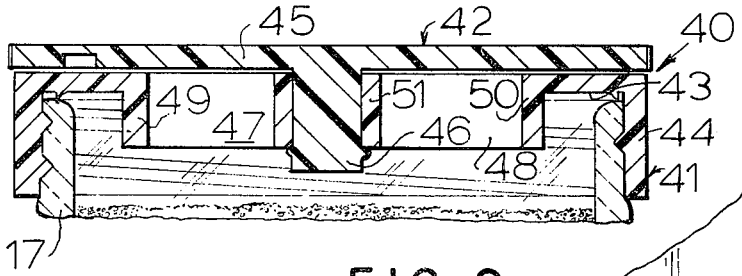
FIG. 9
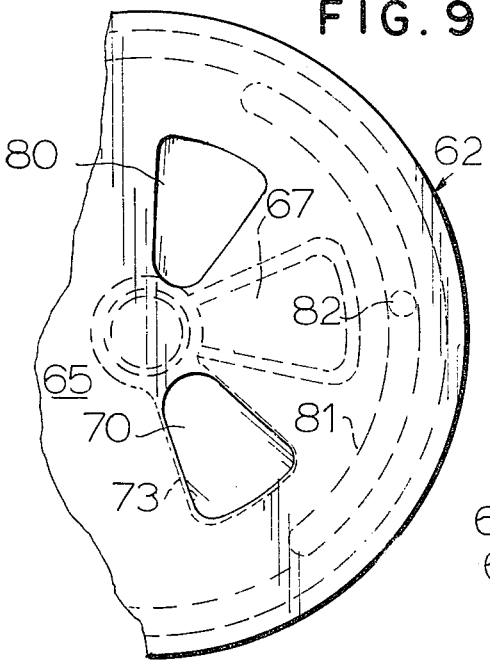
FIG. 8
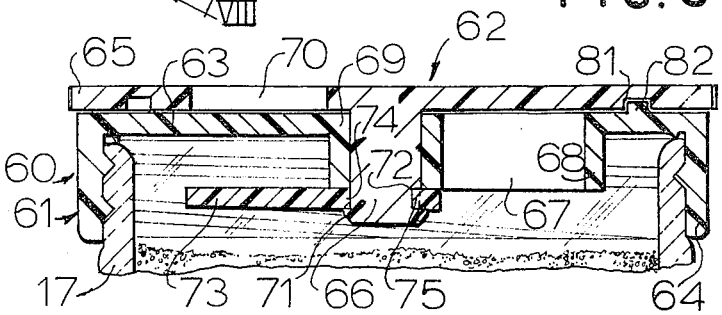

ROTATING DISPENSER CAP

BACKGROUND OF THE INVENTION

The invention relates to granular material dispensing devices and, more particularly, to a rotary dispensing cap having a relatively rotatable disk portion which may be turned to a given position and manipulated in a simple manner to release a predetermined quantity of the material.

Various arrangements have been proposed for providing a dispenser in the closure cap of a jar or similar container filled with discrete granulated or powdered solids material, such as instant coffee or granulated sugar. Many of these heretofore devices include a cylindrical body having one end threaded for connection to the mouth of a standard-size jar or container so as to be readily attachable to the container holding the material to be ejected. However, the previously known dispenser cap devices are typically of complicated constructions having many working parts and are relatively expensive to produce. A further drawback with typical previously known devices is that their manipulation is cumbersome and awkward to the user.

U.S. Pat. No. 3,129,853 discloses a rotary dispensing apparatus arranged to be received as a cap closure on the threaded neck portion of a jar containing granular material. The dispenser includes a raised end cap member defining a hollow chamber positioned outward beyond the top of the jar. A circular plate formed with a cylindrical trap chamber is rotatable within the end cap chamber against the bias of a torsion spring to move a metered quantity of granular material from a receiving position in communication with the contents of the jar to a dispensing position communicating with a hole formed in the top surface of the end cap. U.S. Pat. No. 3,327,905 discloses a rotatable dispensing mechanism which fits into a hollow collecting chamber recessed in the lid surface of a granular material container. This dispenser includes a circular dispensing member mounted for rotation in the hollow chamber and formed with a trap chamber. The dispensing member has a stop formed on it outer surface which is received in an arcuate aperture formed in an external cover plate, such that the user may manipulate the stop to position the trap chamber at various angular positions in the hollow recess. The dispensing member has a first position for receiving a flow of granular material from the container, a second position for dispensing the predetermined quantity of collected material through an opening in the cover plate, and a third position communicating the interior of the container directly with a further opening in the cover plate so that the granular material may pour freely from the interior of the container through the trap chamber to the exterior of the container. Aside from being complicated constructions and hence expensive to produce, these typical known rotary dispensing devices require provision for hollow chamber spaces separate from the interior of the jar or container in which the material is collected in an enclosed trap area whereupon the trap material is passed to an ejection outlet.

The present invention is directed to a rotary dispensing device which serves as a cap closure for a jar or container, eliminating the need for forming a separate hollow space apart from the the interior of the jar or container. The invention is of a simplified construction, thus making it relatively inexpensive to produce, and which may be turned to a given position and manipulated in a simple manner to release a predetermined quantity of material.

SUMMARY OF THE INVENTION

The invention concerns a rotary dispensing device for discharging discrete solids material, such as instant coffee and the like, as a closure cap for a jar or similar container filled with the solids. The device comprises a cylindrical closure cap body having one end threaded for connection to the mouth of the jar or container and formed with an enclosed collection area or chamber. The collection chamber is disposed in direct communication with the interior of the jar or container, so as to become filled with a predetermined metered quantity of material when the jar or container is inverted. Positioned externally over the top surface of the cylindrical body is a metering disk having a discharge opening through which material is dispensed. The disk is formed with an inwardly extending shaft member supported for rotation in the cylindrical body and suitably adapted for rotary movement by the user relative to the jar or container to permit a selective discharge of material. The inner end of the shaft member is formed with a valve or blocking plate having a plan profile area slightly greater than the plan cross-sectional area of the collection chamber. The plate directly underlies the discharge opening formed in the disk. When the disk is rotated to a position bringing the discharge opening in line with the collection chamber, only the material collected therein pours out through the discharge opening since the valve plate serves to close off the interior open end of the collection chamber from communication with the further material contained in the jar or container interior It is further within the contemplation of the present invention that the disk may be formed with a second discharge opening spaced angularly from the first discharge opening overlying the valve plate to permit the user to obtain a free flow of material from the jar or container. When the disk is rotated such that the second discharge opening is in line with the collection chamber, granular material may pour freely from the interior of the jar or container through the collection chamber and second discharge opening. It is also within the contemplation of the present invention to provide the cylindrical body with more than one enclosed collection chamber spaces having different predetermined collection volumes. When the user rotates the disk to align the discharge opening with the first collection chamber, a first measured quantity of granular material is dispensed. When the user aligns the disk discharge opening over the second collection chamber, a second, different measured quantity of granular material is dispensed

BRIEF DESCRIPTION OF THE DRAWING

FIG. 5 is a perspective, assembly view of a cylindrical body portion and relatively rotatable metering disk portion of the dispensing device of FIG. 1.

FIG. 6 is a plan view of a rotary dispensing device constructed in accordance with a second embodiment of the present invention.

FIG. 7 is a cross-sectional view taken along the lines VII—VII of FIG. 6.

FIG. 8 is a cross-sectional view of a rotary dispensing device constructed in accordance with a third embodiment of the present invention connected to a jar containing granular powdered material.

FIG. 9 is a broken-away, plan view of the dispensing device of FIG. 8.

DESCRIPTION OF THE PREFERRED EMBODIMENTS

Figure 1:
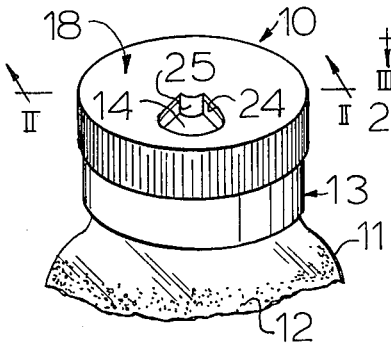
FIG. 1 is a fragmentary perspective view of a rotary dispensing device constructed in accordance with the present invention connected to a jar containing granular or powdered material.

FIGS. 1–5 show a rotary dispensing device 10 for metering granular or powdered solids material, such as instant coffee or sugar. The dispenser 10 serves as a closure cap for a suitable jar or container containing the solids material. For purposes of this discussion the dispenser 10 is in the form of a coffee dispenser attached to the mouth of a standardsize jar 11 containing a quantity of granular or powdered instant coffee 12. It will be understood that jars 11 are commonly manufactured to have interchangeable caps and that, therefore, the dispenser 10 will fit jars of a variety of different brands. It will be further understood that the dispenser 10 may be manufactured of a suitable resilient molded plastic material The dispenser 10 is a two-piece construction. The first piece comprises a cylindrical cap body 13 having a planar top surface 14 and an annular, downwardly extending skirt or sidewall portion 15. Lower end of the sidewall 15 is formed with internal threads 16 of a diameter which permit attachment to the conventional threaded end of the jar neck or mouth 17. The second piece comprises a rotatable metering disk member 18 positioned in external overlying relationship with the top surface 14 of the cylindrical body 13. The disk 18 has a planar top surface 19 overlying the cylindrical body top 14 and extending parallel therewith and an annular, downwardly extending skirt wall 20 concentrically encompassing an upper portion of the cylindrical body skirt wall 15.

As shown in FIG. 5, the top surface 14 of the cap body 13 is formed with a keyhole shaped opening defined by a downwardly extending peripheral wall 21. The peripheral wall 21 serves to enclose a pie-shaped collection chamber area 22 open at opposed upper and lower ends and includes an open-ended semicircular segment 23 which serves as a shaft support wall in a manner described below. The collection chamber 22 defines a predetermined volume for containing a specific measured quantity of coffee particles, such as, for example, one-half teaspoon. When the cylindrical body 13 is attached to the mouth 17 of the jar 11, the lower open end of the collection chamber 22 is disposed toward and directly communicates with the interior contents of the jar. The hollow area defined by the sidewall segment 23 is taken up by a shaft when the dispenser 10 is assembled, such that this area is not considered to be included as part of the collection chamber volume 22.

The metering disk 18 is formed with a generally pie-shaped discharge opening 24 in the top surface 19 thereof. The shape and plan cross-sectional area of the discharge opening 24 is substantially identical with the plan cross-sectional area of the collection chamber 22. Extending downwardly centrally of the disk top surface 19 is a cylindrical shaft member 25, a portion of which forms the radially interior wall of the discharge opening 24. The lower free end of the shaft member 25 is formed with a generally pie-shaped, planar valve or locking plate 26. The valve plate 26 is fixedly connected to the shaft 25 so as to directly underlie the discharge opening 24. The plan shape of the valve plate 26 is substantially identical to the plan shapes of the discharge opening 24 and collection chamber 22; however, the plan cross-sectional area of the valve plate, apart from that which is contiguous with the lower free end of the shaft 25, is slightly peripherally enlarged relative to the plan cross-sectional areas of the discharge opening 24 and collection chamber 22. The external peripheral surface of the disk skirt wall 20 is formed with corrugations or equivalent roughened surface means 27 to provide a gripping edge for the user during dispensing operation.

Figure 2:
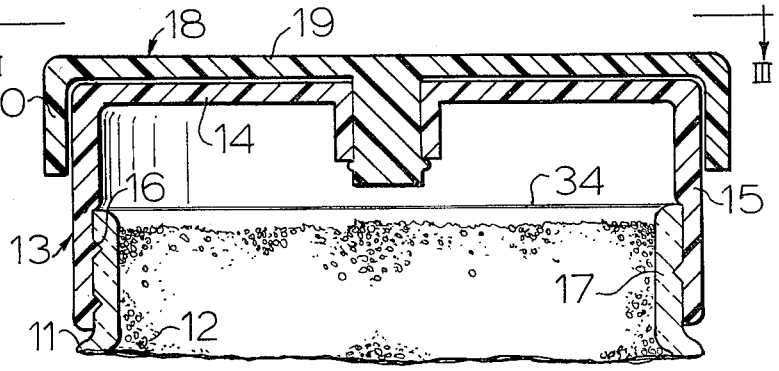
FIG. 2 is a cross-sectional view taken along the lines II—II of FIG. 1.

Referring to FIGS. 2 and 5, the two pieces of the dispenser 10 are assembled such that the metering disk 18 is relatively rotatable over the top surface 14 of the cylindrical body 13, which is fixedly attached to the jar 11. During assembly, the disk 18 is positioned directly overlying the top surface 14 of the cylindrical body 13 and passed downwardly such that the shaft member 25 is received in the semicircular sidewall segment 23 and the valve plate 26 passes downwardly through the collection space 22. During this assembly movement, the valve plate 26 becomes slightly deformed along its peripheral edges as they abut against the inner surfaces of the collection chamber sidewall 21. The metering disk is in place upon the cylindrical body 13 when the valve plate 26 is disposed fully beneath the lower open end of the collection chamber 22. Due to the flow characteristics of granular or powdered material, the upper surface of the valve plate 26 need not be in extremely close tolerance with the lower bottom edge of the collection chamber sidewall 21 when the dispenser 10 is assembled. Due to the resiliency of the plastic material from which the valve plate 26 is made, the peripheral edges of the valve plate assume their original planar condition after insertion through the collection chamber 22.

The shaft 25 may be formed with stop or positioning rings 30 and 31 adjacent the upper and lower ends, respectively, thereof. The peripheral diameters of the rings 30 and 31 are slightly greater than the circular opening defined by the sidewall segment 23, such that the lower ring 31 serves to lock the shaft 25, as well as the disk 18, into connection with the cylindrical body 13 and the upper ring 30 serves to provide an annular clearance space between the upper surface of the body top 14 and the under surface of the disk top 19, permitting free rotation of the disk 18 relative to the cylindrical body 13.

Figure 3:
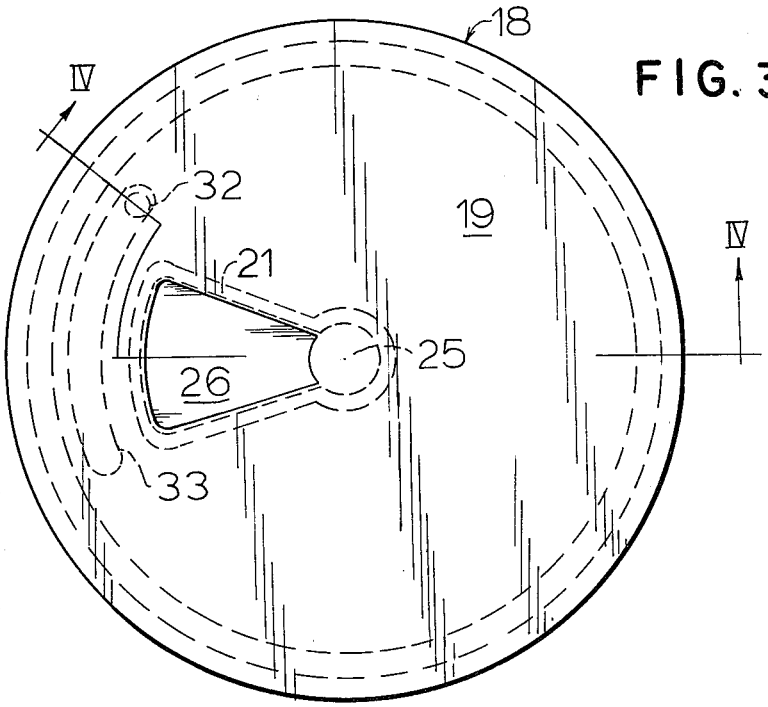
FIG. 3 is a plan view taken along the lines III—III of FIG. 2.
Figure 4:
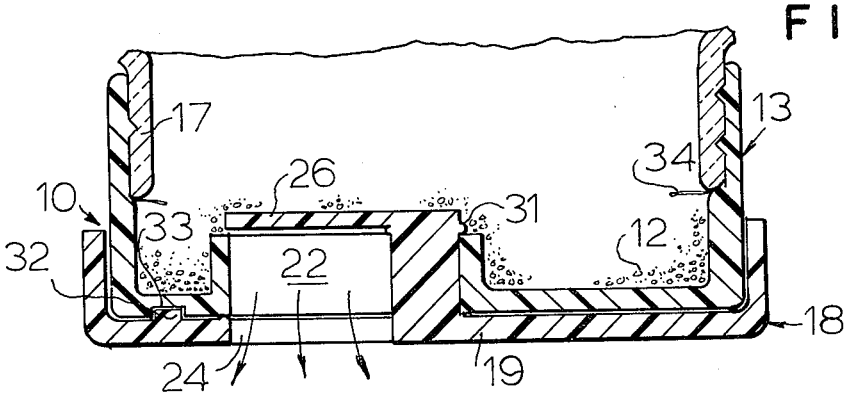
FIG. 4 is a cross-sectional view taken along the lines IV—IV of FIG. 3, when the jar of FIG. 1 is inverted for dispensing a predetermined measured quantity of material.

With reference to FIGS. 3 and 4, the disk top surface 19 is formed with a downwardly protruding rib or abutment member 32 which is received in an arc-shaped recess or trough 33 formed along the upper surface of the cylindrical body top 14. The opposed radial ends of the trough 33 serve as end limits for rotational movement of the disk 18 about the cylindrical body 13.

Operation of the dispensing device 10 is as follows. The closure cap 10 is initially unscrewed from the jar 11 to permit the user to break or tear away a conventional paper seal 34 positioned across the top of the jar mouth 17. This paper seal 34 is conventionally used by retail coffee packagers as a tamper-proof device as well as a freshness seal. The closure cap 10 is then re-attached to the jar neck 17 for selective dispensing of the coffee material. For dispensing, the user inverts the jar 11 such that the coffee contents fall towards the closure cap end of the jar. The user turns the disk 18, so as to bring the disk abutment member 32 adjacent one radial end wall of the trough 33. At this position, the valve plate 26 is angularly disposed apart from and out of alignment with the collection chamber 22, such that the collection chamber 22 is directly exposed in and communicates with the interior contents of the jar 11. The coffee material collects in the chamber space 22 in an amount defined by its volume, which is here defined as one-half teaspoon. The user then rotates the disk 18 in the opposite direction so as to bring the abutment member 32 adjacent the opposite end of the trough 33, as shown in FIG. 3. At this position, coffee material collected in the chamber 22 is dispensed exterior of the jar 11. The collection chamber sidewall 21 is placed in substantial alignment with the valve plate 26 such that the inner open end of the collection chamber 22 is blocked from flow communication with the interior contents of the jar and the upper open end of the collection chamber 22 is exposed to atmosphere through the discharge opening 24 directly overlying the valve plate 26. The granular material collected in the chamber 22 falls under the influence of gravity out through the discharge opening 24 in the manner illustrated in FIG. 4. If the user desires a further discharge of coffee from the jar 11, the process is simply repeated until the desired amount of coffee has been dispensed.

FIGS. 6 and 7 illustrate a further embodiment of the present invention wherein the user is provided an option as to the volume amount of granular material desired to be dispensed during one application. In these figures, a rotary dispensing device 40 is shown serving as the closure cap attached to the mouth 17 of the coffee jar 11. In accordance with the invention, the dispenser 40 is a two-piece construction consisting of a cylindrical cap body 41 and a relatively rotatable metering disk member 42. The cylindrical body 41 has a planar top surface 43 and an annular, downwardly extending skirt portion 44 formed with interior threads permitting attachment to the threaded end of the jar mouth 17. The disk 42 is formed of a planar top surface 45 and a downwardly extending, centrally disposed shaft member 46.

The top surface 43 of the cylindrical body 41 is formed with two, generally opposed keyhole openings respectively defined by downwardly extending peripheral walls 49 and 50. The peripheral walls 49 and 50 serve to enclose pie-shaped collection chamber areas 47 and 48, respectively. The collection chambers 47 and 48 define predetermined volume spaces for containing specific measured quantities of coffee particles. In accordance with this embodiment, the chamber space 47 is approximately one-half the volume of the chamber space 48, with the chamber space 47 preferably defining a onehalf teaspoon volume. When the cylindrical body 41 is attached to the mouth 17 of the jar 11, the lower open ends of the collection chambers 47 and 48 are disposed toward and communicate directly with the interior contents of the jar.

The inner radial ends of the peripheral walls 49 and 50 connect with arcuate segments of a substantially circular wall 51 protruding downwardly from the cylindrical body top 43 to define a hollow area taken up by the shaft 46 when the dispenser 40 is assembled. The lower free end of the shaft member 46 is formed with a generally pie-shaped, planar valve plate 52, which is fixedly connected to the shaft. The valve plate 52 is positioned to directly underlie a discharge opening 53 formed in the top surface 45 of the disk 42. The plan profile shapes of the valve plate 26, the discharge opening 53, and the peripheral wall 50 are substantially identical; however, the plan cross-sectional area of the valve plate is slightly peripherally enlarged relative to the plan cross-sectional areas of the discharge opening 53 and the collection chamber 48.

The disk and cylindrical body pieces of the dispenser 40 are assembled in substantially the same manner as the first embodiment device, such that the disk shaft 46 is passed downwardly through the circular opening formed by the wall member 51. During assembly, the valve plate 52 passes through the chamber space 48, during which passage the peripheral edges of the plate 52 deform slightly as they abut against the inner surfaces of the collection chamber sidewall 50. When the disk 42 is properly assembled with the cylindrical body 41, the valve plate 52 underlies the lower ends of the collection chambers 47 and 48 and the disk member 42 is rotatable relative to the cylindrical body.

The device 40 operates in the manner of the first embodiment device. A relatively enlarged arc-shaped trough 54 is formed in the undersurface of the disk top surface 45 for receiving a raised rib or abutment member 55 formed on the upper surface of the cylindrical body top 43 for defining the extent of rotational movement of the disk 42 about the cylindrical body 41. At the position of the disk 42 such that the rib member 55 is approximately intermediately positioned along the arcuate trough 54, the collection chambers 47 and 48 are exposed in and directly communicate with the interior contents of the jar 11. The collection spaces 47 and 48 are accordingly filled with their respective predetermined volumes of coffee material. Depending on whether the user wishes to discharge the smaller or larger chamber volume of coffee, the user rotates the disk 42 in one direction or the other from the position shown in FIG. 6. When the user rotates the disk in the counterclockwise direction as shown in FIG. 6, the valve plate 52 is brought into a blocking position beneath the lower open end of the smaller chamber 47 and that chamber's contents are dispensed through the discharge opening 53. Similarly, if the user desires a larger volume of coffee to be dispensed, the disk is rotated in the clockwise direction from the position shown in FIG. 6 and the contents contained in the collection space 48 are dispensed exterior of the jar through the discharge opening 53.

FIGS. 8 and 9 illustrate a still further embodiment of the present invention wherein the dispensing device of the present invention may be operated to dispense a one-shot, predetermined quantity of granular material or alternately permit granular material to pour freely from the interior of the jar. In this embodiment, a rotary dispensing device 60 is shown constructed similarly with the device 40 illustrated in FIGS. 6 and 7 to serve as the cap closure for the jar 11 containing coffee material. The device 60 is a two-piece construction consisting of a cylindrical body 61 and relatively rotatable metering disk member 62. The cylindrical body 61 is formed with a planar top surface 63 and an annular, downwardly extending skirt portion 64 having internal threads which permit attachment to the threaded end of the jar mouth 17. The disk member 62 comprises a planar top surface 65 overlying a centrally disposed, downwardly extending shaft member 66.

In contrast to the device 40 construction, the cylindrical body 61 is formed with one keyhole opening defined by a peripheral wall 68 extending downwardly from the cylindrical body top 63 and enclosing a collection chamber 67 formed with upper and lower open ends. The collection chamber 67 defines a predetermine volume for containing a specific measured quantity of coffee particles, such as one-half teaspoon. The radial inner ends of the peripheral wall 68 connect with a circular wall 69 extending downwardly from the cylindrical body top 63 defining a centrally disposed hollow are to be taken up by the shaft member 66 when the dispenser 60 is assembled.

The disk top 65 is formed with a generally pie-shaped discharge opening 70 having a plan profile shape and cross-sectional area substantially identical with the plan shape and cross-sectional area of the collection chamber 67. The lower free end of the shaft member 66 is formed with a relatively enlarged, truncated tip portion 71 which, when the disk 62 is assembled to the cylindrical body 61, defines an overlying circumferential space beneath the lower ends of the circular wall 69. Within this circumferential space, the lower end of the shaft 66 is formed with a radially recessed opening 72. In accordance with this embodiment, a valve plate 73 is utilized which is not integrally formed at the lower end of the dispenser shaft member. The valve plate 73 has a generally pie-shaped planar shape and cross-sectional area substantially identical to the plan shape of the collection chamber 67, but being slightly peripherally enlarged relative to the plan cross-sectional area of the collection chamber 67. The valve plate 73 has a vertical circular opening 74 formed adjacent its radially inner end having a diameter permitting it to snugly receive the diameter of the shaft member 66 overlying the tip portion 71. The circular opening 74 is formed with a radially inward extending rib member 75, adapted to be received in the recess opening 72, such that when the valve plate 73 is assembled on the shaft member 66, the major portion of the valve plate is positioned to directly underlie the discharge opening 70. The valve plate 73 is assembled onto the lower end of the shaft member 66 by forcing the valve plate opening 74 over the shaft tip portion 71, such that the valve plate is received in the circumferential space about the shaft underlying the lower ends of the circular wall 69. Accordingly, the valve plate 73 rotates with the disk shaft member 66.

Aside from the discharge opening 70 formed on the disk top surface 65 to overlie the valve plate 73, there is also formed in the disk top a second discharge opening 80. As shown in FIG. 9, the further discharge opening 80 has a pie-shaped plan cross-sectional area substantially identical to the plan shape and cross-sectional area of the discharge opening 70 and the further opening 80 is angularly spaced on the disk top 65 from the opening 70. The disk top opening 70 permits the user to discharge one-shot, premeasured quantities of granular material from the jar; whereas the further disk opening 80 allows the user to obtain a free pouring flow of granular material from the jar.

Operation of the dispenser 60 is as follows. In the manner of the dispenser 40 shown in FIGS. 6 and 7, an arcuate shaped trough portion 81 is formed along the undersurface of the disk top 65 to receive a raised rib member 82 formed on the upper surface of the cylindrical body during rotation of the disk 62 relative to the cylindrical body 61. When the disc member 62 is positioned relative to the cylindrical body 61 such that the rib member 82 lies generally intermediately along the arcuate length of the trough 81, as shown in FIG. 9, the upper open end of the collection chamber 67 is blocked by the solid portion of the disk top 65 and the lower open end of the collection chamber is exposed in and directly communicates with the interior contents of the jar 11. For dispensing of granular material from the jar 11, the user inverts the jar such that coffee material falls toward the closure cap 60 and enters the collection chamber 67. If the user desires to dispense a premeasured quantity of coffee in a one-shot discharge, the user rotates the disk 62 in the counterclockwise direction, as shown in FIG. 9, until the lower radial end wall (in the clockwise direction) is positioned adjacent the rib member 82. In this position, the discharge opening 70 substantially overlies the open upper end of the collection chamber 67 and the valve plate 73 substantially underlies the open bottom end of the collection chamber 67 to block off the collection chamber from further flow communication with the interior contents of the jar. The quantity of coffee material collected in the chamber space 67 then passes through the discharge opening 70 exterior of the jar. If the user desires a further single-shot discharge from the collection chamber 67, this action is repeated.

If the user desires to pour granular material freely from the interior of the jar, the disk 62 may be rotated in the clockwise direction relative to the cylindrical body 61, as shown in FIG. 9, such that the further discharge opening 80 overlies the open end of the collection chamber 67. In this second dispensing position, the upper end radial wall of the trough 81 (in the counterclockwise direction) is brought to a position adjacent the rib member 82. Since, in this position, no valve plate underlies the lower open end of the collection space 67 and the collection space is in direct communication with the interior contents of the jar, coffee may pour freely from the interior of the jar through the collection area 67 and out through the discharge opening 70 to the exterior of the jar 11.

Although various minor modifications may be suggested by those versed in the art, it should be understood that I wish to embody within the scope of the patent warranted hereon all such modifications as reasonably and properly come within the scope of my contributionn to the art. 9n

I claim as my invention:

1. A dispenser for granular solids material comprising:

a container having an orifice defined by an externally threaded neck portion, a cap body having a cap surface disposed across said orifice and an internally threaded peripheral wall threadably engaged with said neck portion, a peripheral wall formed on said cap surface defining a keyhole opening having an open upper end facing exterior of said cap surface and an open lower end exposed in and facing in direct communication with the interior of said container, a generally solid metering disk overlying said cap surface and having a shaft member supported in a semi-circular segment of said keyhole opening for rotation of said disk relative to said cap body.

a collection chamber defined by the remainder of said keyhole opening, a discharge opening in said disk disposed to overlie said collection chamber upon selective rotation of said disk, and a valve means connected for rotation with said shaft member directly underlying said discharge opening, and disposed spaced beneath the lower end of said collection chamber so as not to be in contiguous relation therewith, for blocking flow communication between the interior of said container and the lower end of said collection chamber when said discharge opening overlies said collection chamber upper end.

2. The dispenser of claim 1, wherein said discharge opening and collection chamber have plan profile shapes and cross-sectional areas substantially identical.

3. The dispenser of claim 2, wherein that portion of said valve means underlying said discharge opening is of a plan profile shape similar to that of said discharge opening and collection chamber and has a cross-sectional area peripherally enlarged relative to that of said discharge opening and collection chamber.

4. The dispenser of claim 3, wherein said valve means is made of resilient material enabling said valve means to be preconnected to said shaft member and passed through said collection chamber when said disk is assembled to said cap body.

5. The dispenser of claim 1, comprising a free-pour discharge opening in said disk angularly spaced from said discharge opening and disposed to overlie said collection chamber upper end upon selective rotation of said disk.

6. The dispenser of claim 1, comprising a further peripheral wall formed on said cap surface defining a further, relatively smaller, collection chamber having an open upper end facing exterior of said cap surface and an open lower end exposed in and facing in direct communication with the interior of said container, said valve means blocking flow communication between the interior of said container and lower end of said further collection chamber when said discharge opening overlies said further collection chamber upper end.

7. The dispenser of claim 1, wherein said valve means is integrally formed on said shaft member.

8. The dispenser of claim 1, comprising means for restricting rotation of said disk relative to said cap body to a predetermined arc length.

9. A cap closure to a container for dispensing granular solids material through an outlet in said container comprising:

a cap body for covering said outlet and attaching to said container, a peripheral wall formed on said cap body defining a collection chamber having an open upper end for facing exterior of said container and an open lower end for being disposed in and facing in direct communication with the interior of said container, a generally solid metering disk overlying said cap body and having a shaft member supported in said cap body for rotation of said disk relative to said cap body, a discharge opening in said disk disposed to overlie said collection chamber upper end upon selective rotation of said disk, and a valve means connected for rotation with said shaft member directly underlying said discharge opening, and disposed spaced beneath the lower end of said collection chamber so as not to be in contiguous relation therewith, for covering over said collection chamber lower end when said discharge opening overlies said collection chamber upper end.

10. The cap closure of claim 9, wherein said discharge opening and collection chamber have plan profile shapes and cross-sectional areas substantially identical.

11. The cap closure of claim 10, wherein that portion of said valve means underlying said discharge opening is of a plan profile shape similar to that of said discharge opening and collection chamber and has a cross-sectional area peripherally enlarged relative to that of said discharge opening and collection chamber.

12. The cap closure of claim 11, wherein said valve means is made of resilient material enabling said valve means to be pre-connected to said shaft member and passed through said collection chamber when said disk is assembled to said cap body.

13. The cap closure of claim 9, comprising a free-pour discharge opening in said disk angularly spaced from said discharge opening and disposed to overlie said collection chamber upper end upon selective rotation of said disk.

14. The cap closure of claim 9, comprising a further peripheral wall formed on said cap body defining a further, relatively smaller, collection chamber having an open upper end for facing exterior of said container and an open lower end for being disposed in and facing in direct communication with the interior of said container, said valve means covering over said further collection chamber lower end when said discharge opening overlies said further collection chamber upper end.

15. The cap closure of claim 9, wherein said valve means is integrally formed on said shaft member.

16. The cap closure of claim 9, comprising means for restricting rotation of said disk relative to said cap body to a predetermined arc length.

17. The cap closure of claim 9, wherein said valve means comprises a planar plate disposed radially outward of said shaft member.

18. Apparatus for assembling a rotatable cap closure dispenser for a container comprising:

a cap body for covering an outlet in said container and attaching to said container, said cap body having a top surface formed with a keyhole opening, extending radially from the center of said top surface and defined by a peripheral wall extending vertically from said top surface, a disk body for connecting to said cap body having a generally solid surface formed with an opening extending radially from the center of said solid surface, a shaft extending vertically from the center of said solid surface, and a generally planar plate extending radially outward from the free end of said shaft and underlying said opening, said shaft and plate together having a planar profile shape substantially identical with the planar profile shape of said keyhole opening and being adapted to be received through said keyhole opening such that said plate lies in a plane beneath said peripheral wall, and said plate being made of resilient material and of a planar area requiring its periphery to deform as it is passed along said peripheral wall.

19. The apparatus of claim 18, comrising a circumferential rib formed about said shaft adjacent the free end thereof for substantially preventing removal of said shaft from said keyhole opening after said plate has passed beneath said peripheral wall.

20. The apparatus of claim 18, wherein said disk has a free-pour opening extending radially from the center of said solid surface and spaced angularly from said opening.

21. The apparatus of claim 18, wherein said cap body top surface has a further opening extending radially from the center of said top surface, angularly spaced from said keyhole opening, and defined by a further peripheral wall encompassing a smaller planar cross-sectional area than said keyhole opening peripheral wall and extending vertically from said top surface an equal distance with said keyhole opening peripheral wall.

* * * * *